United States Patent [19]

Babuka et al.

[11] 4,260,210

[45] Apr. 7, 1981

[54] PLUGGABLE MODULE ACTUATION AND RETENTION DEVICE

[75] Inventors: Robert Babuka, Vestal; William D. Emmons, Endicott; Robert L. Weiss, Apalachin; Peter Yacko, Endwell, all of N.Y.

[73] Assignee: International Business Machines Corporation, Armonk, N.Y.

[21] Appl. No.: 53,498

[22] Filed: Jun. 29, 1979

[51] Int. Cl.[3] ..... H01R 13/635; H01R 13/639

[52] U.S. Cl. ..... 339/91 R; 339/64 M; 339/75 M

[58] Field of Search ..... 339/17 CF, 179, 75 M, 339/75 R, 79 R, 69 R, 69 M, 45 R, 45 M, 91 R

[56] References Cited

U.S. PATENT DOCUMENTS

| | | | |
|---|---|---|---|
| 3,315,212 | 4/1967 | Peterson | 339/75 M |
| 3,488,622 | 1/1970 | Gley | 339/75 M X |
| 3,534,320 | 10/1970 | Rushing | 339/75 M X |
| 3,915,537 | 10/1975 | Harris et al. | 339/64 R |
| 4,059,323 | 11/1977 | Babuka et al. | 339/75 M |

OTHER PUBLICATIONS

Module Holder and Actuator, R. A. Jarvela, IBM Tech. Disclosure Bulletin, vol. 16, No. 12, May 1974, pp. 3975–3976.

Linear Actuation Device, Babuka et al., IBM Tech. Disclosure Bulletin, vol. 21, No. 11, Apr. 1979, pp. 4441–4443.

*Primary Examiner*—Eugene F. Desmond

*Attorney, Agent, or Firm*—Gerald R. Gugger

[57] ABSTRACT

A pluggable module actuation and retention device comprising a spring housing fastened to a printed circuit board and having openings which contain a matrix of contact springs extending from said board. A bail retaining latch is fastened to the spring housing and an actuator bail is pivotally mounted on the spring housing and has an opening which overlies the openings in the spring housing. A module to be actuated and retained has a matrix of pins corresponding to the matrix of contact springs and is provided with actuator tabs. Actuator tab mating means are provided on the spring housing for engaging the module actuator tabs when a module is inserted through the opening in the actuator bail to align the matrix of pins with the matrix of contact springs. Camming means on the actuator bail are effective when the bail is pivoted in one direction to engage the actuator tabs and slide the module to move the matrix of pins on the module into engagement with the matrix of contact springs. Arm portions on the bail are engaged by the bail retaining latch when the pins and contact springs are engaged.

3 Claims, 9 Drawing Figures

PLUGGABLE MODULE ACTUATION AND RETENTION DEVICE

BACKGROUND OF THE INVENTION

In integrated circuit packaging, it is common practice to bond the connectors of the integrated circuit chip to a printed circuit pattern on a substrate material, such as a ceramic material. Connection to the printed circuit pattern is made by pins which pass through the substrate and are conductively connected to the pattern on one side of the substrate and project perpendicular to the plane of the substrate on its opposite side. As the number of devices per integrated circuit chip increases and as the number of connections necessarily increases, it is obvious that the number of external connections, e.g. input/output (I/O), pins on the substrate, must also increase. Insertion of the pins of the substrate into a socket on a printed circuit board is a problem because of the additional force required to insert a plurality of pins into friction-type female connectors. The use of excessive force can create problems inherent with bent pins, misaligned female connectors and/or pins, and the possibility of bending pins during insertion. In addition, the use of large electronic modules has given rise to the need for dense area array connector systems.

There has recently come into being a dense area array connector system which overcomes the above-mentioned problems and which is adapted for use with a wide range of module sizes. The system is employed in a broad spectrum of applications to interconnect modules and cards to mating printed circuit boards and it is fully disclosed in U.S. Pat. No. 3,915,537. Briefly, the system comprises a zero insertion force electrical connector which is adapted for incorporation into a printed circuit board or similar arrangement. The connector comprises a bifurcated spring yoke having flat longitudinally and upwardly extending arms, each with cylindrical or barrel-shaped contact surfaces in opposing and spaced apart relationship and chamfered at their respective entry ends to facilitate entry of the pin into the gap between said surfaces. The connector includes a longitudinally and downwardly extending mounting post or stem adapted to connect the connector device with a printed circuit board.

The elimination of insertion forces is accomplished by first locating the connecting pins in an area at a position adjacent the chamfered ends of the contact surfaces and then moving the pins slideably and transversely in guided relation between the opposing contact surfaces.

Alternately, the shaping of the contact surfaces and the resiliency of the upwardly extending arm provides an electrical connector having a low insertion force when the pin is longitudinally introduced between the contact surfaces, the opposing cylindrical or barrel-shaped surfaces serving the function of the chamfers during insertion of the pin. But in either the transverse or in-line-insertion, the opposing contact surfaces will assure line contact of each contact arm with the pin.

With the advent of larger pluggable modules having a higher count or number of I/O pins, it became desirable to employ the above-described dense area array connector system and to use the system in a zero insertion mode wherein the pins are slideably and transversely guided into engagement with the mating spring contact surface. It then became evident that what was needed was an actuating mechanism which would allow the module to be plugged in with the actuator serving as a camming vehicle as well as a module retention device. Examples of known actuating devices of this type are disclosed in IBM Technical Disclosure Bulletin, Vol. 16, No. 12, May 1974, pages 3975–3976; and, also in U.S. Pat. No. 4,059,323. These devices proved to be complex and expensive and lacking in features that were desired.

SUMMARY OF THE INVENTION

The present invention provides an improved and unique device for actuating and retaining a high I/O pin count pluggable module to a printed circuit board which has a matrix of contact springs extending from one surface thereof. Fastened to said surface of the board is a spring housing which has a matrix of openings for housing said contact springs. An actuator bail is pivotally mounted on the spring housing and has an opening which overlies the openings in the spring housing. The module is inserted through the opening in the bail and actuator tabs on the module engage mating slots in the spring housing. At this point, polarization and rough guidance have taken place. Further movement of the module toward the board results in guiding studs on the module engaging mating holes in the spring housing at which point the fine guidance system has taken over to assure that the I/O pins on the module correctly engage the openings in the spring housing.

Visual indication that the module is fully seated with the I/O pins extending into the mating openings in the spring housing and positioned adjacent to the contact springs therein is given by the actuator bail which develops significant free travel once the module is in place. At this point, the actuator tabs will slide slightly under matching ledges in the spring housing to prevent unseating of the module.

Sliding motion of the module to move the I/O pins into engagement with their associated contact springs is accomplished by depressing the actuator bail thereby causing the bail to pivot about its support point thus moving the module in the actuation direction via bosses on the bail engaging and pushing the actuator tabs on the module.

Visual indication that actuation has been accomplished is given by bail retaining latch arms which, upon satisfactory actuation, will engage the actuator bail arms. The angles on the latch points engage matching angles on the bail arms thus providing for an "over center" actuation feature. A positive stop is built into the latch mechanism so that over actuation cannot occur and a similar stop is incorporated to prevent overstressing upon deactuation.

Retention of the module in the actuated position is obtained via the position of the bail which, due to its latched position, prevents the module from backing out. The module is prevented from moving out of its seated position by the module actuator tabs coming into contact with the spring housing. In both cases, the spring/pin frictional force will assist in retention. Deactuation is accomplished by squeezing the latch arms together while simultaneously rotating the bail to pivot it in the deactuation direction.

The design of the present device results in a significant reduction in cost since interfacing with the conventional board stiffener is not required and also the actuator connection is located central to both the module and the spring housing thus effectively splitting the manufacturing tolerances.

Accordingly, a primary object of the present invention is to provide a novel and improved device for actuating and retaining a pluggable module onto a printed circuit board.

A further object of the present invention is to provide a device for actuating and retaining a pluggable module onto a printed circuit board and having actuating means such that no torque is produced which would tend to rotate the module normal to the direction of actuation.

A still further object of the present invention is to provide a device for actuating and retaining a pluggable module onto a printed circuit board wherein actuator means are located centrally to the module to effectively split manufacturing tolerances.

Another object of the present invention is to provide a novel and improved device for actuating I/O pins of a pluggable module into engagement with contact springs on a printed circuit board.

Another object of the present invention is to provide a device for actuating I/O pins of a pluggable module into engagement with contact springs on a printed circuit board wherein actuation and positive retention of the module is accomplished simultaneously.

A further object of the present invention is to provide a device for actuating I/O pins of a pluggable module into engagement with contact springs on a printed circuit board wherein positive indication is given when the module is ready for actuation and positive indication is given when actuation has been completed.

Another object of the present invention is to provide a device for actuating I/O pins of a pluggable module into engagement with contact springs on a printed circuit board wherein over center actuation is automatically accomplished.

A still further object of the present invention is to provide a device for actuating I/O pins of a pluggable module into engagement with contact springs on a printed circuit board and having positive stop means to prevent overactuation and subsequent breakage of parts.

The foregoing and other objects, features and advantages of the invention will be apparent from the following more particular description of a preferred embodiment of the invention, as illustrated in the accompanying drawings.

DESCRIPTION OF PREFERRED EMBODIMENT

Figure 5:
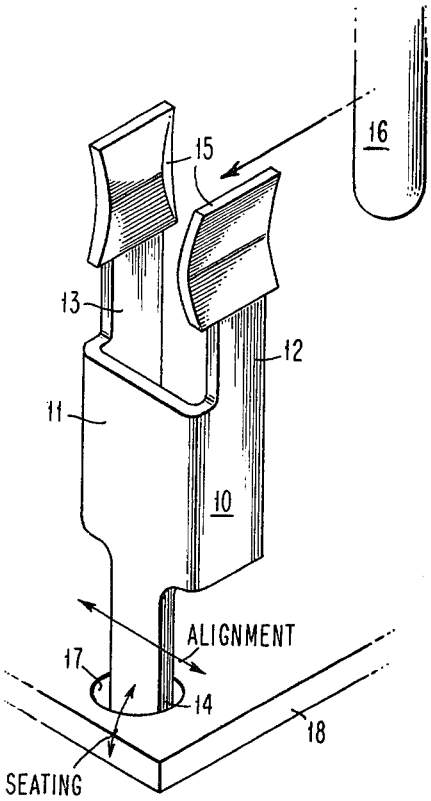
FIG. 5 is an isometric drawing of the contact spring connector element associated with a pin type connector element and the device of the present invention.

Referring first to FIG. 5, the device of the present invention is particularly adapted for use with a contact spring type connector 10 of stamped and formed construction comprising a U-shaped yoke 11 having a pair of spring arms 12 and 13 normal to the yoke 11 and extending longitudinally upward from the facing arms of the yoke. A mounting post or stem 14 extends downwardly from the lower edge of the central portion or base of yoke 11. The upper extremity of each arm 12, 13 is machine fabricated to provide preferably an elongated and cylindrically curved or barrel-shaped contact surface 15 to make line contact with a male connector element 16. Alternatively, a compound surface could be developed and then attached to the upper extremities of the arms 12 and 13 by brazing, soldering, or the like, or a wire element could be shaped to provide a contoured surface and affixed to the upper extremities of the arms 12 and 13. In fabrication, after a stamping operation, the arms 12 and 13 are bent normal to the yoke 11 so that the contact surfaces 15 are in a spaced apart and opposing relationship. The dimension of the space between the opposing contact surfaces 15 is application oriented and less than the dimension of the male connector element 16 to be inserted therebetween. The male connector element 16 is illustrated as a round pin, however, it may be of other configurations, such as a flat tab or equivalent thereof.

The connector 10 is characterized by its multispring rate characteristic. It has an alignment spring rate (in the direction of the alignment arrow in FIG. 5) at the stem 14 which is about one-sixth the spring rate of each contact arm 12, 13 and it also has a seating spring rate (in the direction of the seating arrow) at the stem that is very small (e.g. about one-twentieth) that of each contact spring and, hence, essentially negligible.

The low spring rate (especially the low alignment spring rate) of the stem enables the stem to yield in response to slight misalignment forces resultant from slight relative misalignment of the pin or other male element as it is introduced either laterally or longitudinally into the space between the opposing contact surface 15. This yielding of the stem assures that the facing cylindrical or barrel-like contact surface 15 will each make line contact with the pin 16. Thus, the yielding of the stem and identical spring rates of the opposing contact arms imparts a "floating action" or behavior to the connector device in alignment direction. This floating action feature absorbs some of the tolerance accumulations and, hence, in actual test, has been found to make it possible to install these connector devices on 0.050 inch centers in very high density applications.

One primary application of the contact springs is their use as connectors on a printed circuit board. As illustrated in FIG. 5, the contact springs have their stems 14 soldered in plated-through holes 17 of a printed circuit board 18 and are electrically connected to circuit patterns and/or internal signal and/or ground planes of the board. The pluggable pins 16 form the other half of these connectors and are generally input-output (I/O) pins of an integrated circuit component, module, or the like, which is to be electrically connected to the board. As an example, one application requires the plugging of one or more modules each having over 800 I/O pins into the contact springs of a printed circuit board.

Referring now to FIGS. 1 to 4, the module actuation and retention device of the present invention comprises a mounting frame 19 which is secured to one surface of the printed circuit board 18 by adhesive bonding or other suitable means. The circuit board is provided with a board stiffener member 20. The mounting frame 19 has an opening 21 for exposing a matrix 22 of the contact springs 10 mounted in plated through holes in the circuit board, one of which is illustrated in FIG. 5.

Figure 6:
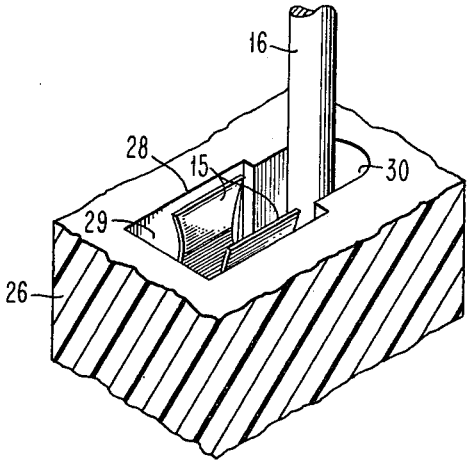
FIG. 6 is an enlarged fragmentary showing of one contact spring in the spring housing of the present device with a module I/O pin inserted adjacent thereto.

Secured to the mounting frame by means of three screws 23 are a spring housing 24 and a bail retaining latch 25. The spring housing and bail retaining latch are preferably molded from a suitable plastic material. The spring housing includes a plate member 26 which has a matrix 27 of through cavities or openings 28 which overlie and are in alignment with the contact springs 10 which protrude from the circuit board. Illustrated in FIG. 6, is one of the cavities 28 of the matrix. Each cavity has a portion 29 which receives and houses the contact arms 12, 13 and contact surfaces 15 of the associated contact spring 10 and the cavity also includes a pin receiving portion 30 for receiving an associated I/O pin 16 from the pluggable module or component. Two opposite sides 31 of the spring housing are each provided with a pair of guide slots 32, 33 for receiving and guiding a module 34, as will be described, and between these guide slots is a slot 35 for receiving the ends of an actuator bail 36. The bail retaining latch 25 is U-shaped and the two latch arms 37 of the bail have a latching point 38 at their free ends. Extending parallel to each latch arm is a stop projection 39, the purpose of which will be described later.

The actuator bail 36 is U-shaped with the two opposite arms 40 of the bail each having an L-shaped configuration. At the free end of each arm 40, a pivoting stud 41 is attached to the outside surface of each arm and a camming stud 42 is attached to the inside surface of each arm. Attached to the top portion of the bail is a curved operating handle 43. The actuator bail is pivotally mounted on the spring housing by positioning the pivot studs 41 into pivot holes 44 in the sides 31 of the spring housing with the free ends of the bail arms and the camming studs positioned in the slots 35. The actuator bail pivot connection is located substantially central to both the module and the spring housing, thus, effectively splitting the manufacturing tolerances.

The module 34 has attached to its top surface a heat sink plate 45 which has a plurality of cooling studs 46 attached thereto. Protruding from the opposite or bottom surface of the module is a matrix of the I/O pins 16. Also, attached to the bottom surface of the module are two guide studs 47 which facilitate correct insertion of the module. Fastened to each of the opposite side edges 48, 49 of the module is a plate 50 which has formed thereon two guide tabs 51, 52 and two actuator tabs 53, 54.

Figure 3:
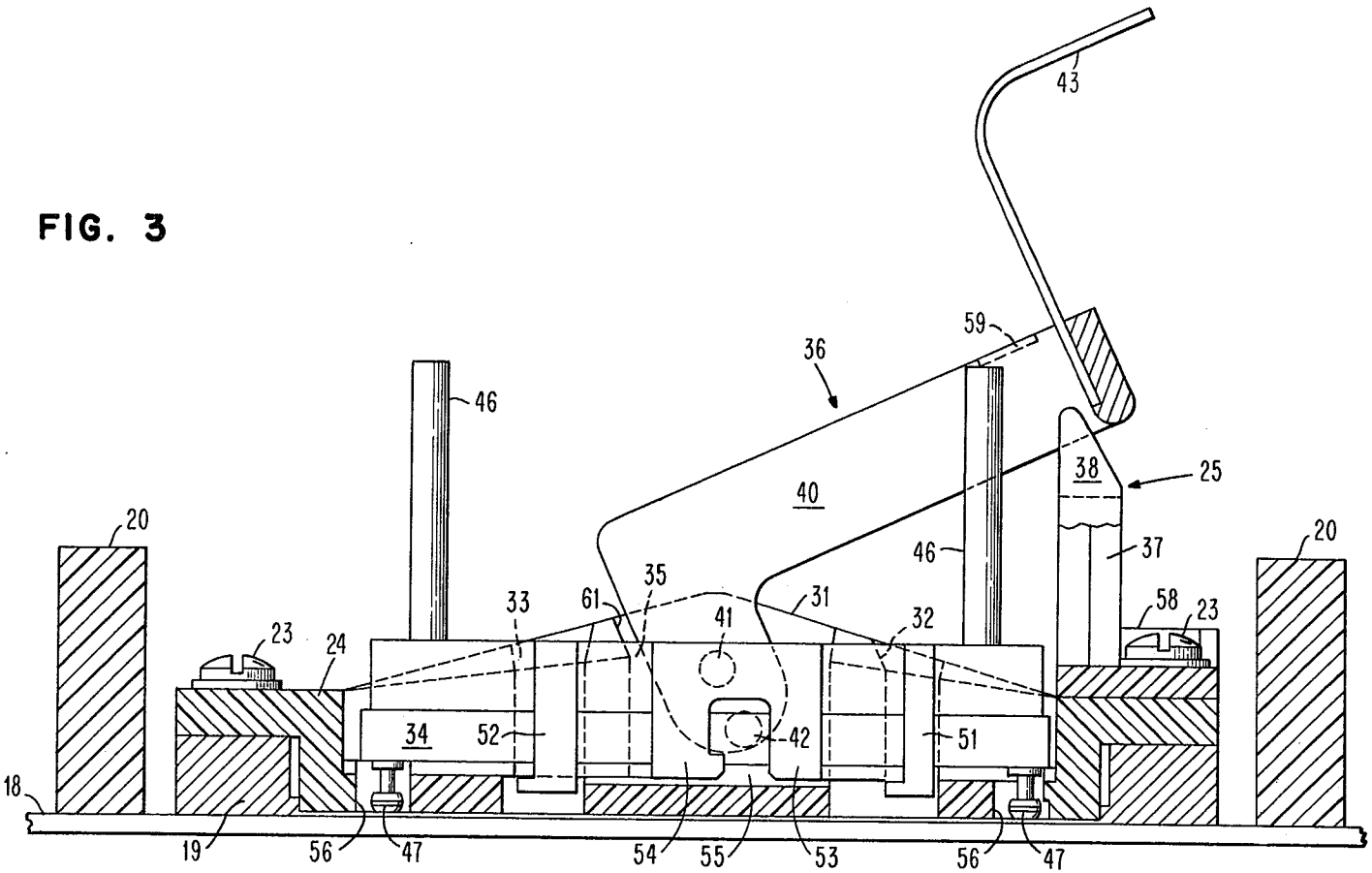
FIG. 3 is a cutaway side view of the assembled device and module prior to actuation.

Referring to FIG. 3, the assembled device is shown prior to actuation of a module. The actuator bail 36 is in a counter-clockwise pivoted position with the bail arms 40 resting on the outwardly sloping surfaces of the latch points 38 on the latch arms 37 of the bail retaining latch 25. The module 34 is inserted through the opening in the actuator bail and the guide tabs 51, 52 and actuator tabs 53, 54 on the module will engage their mating slots 32, 33 and 35 in the sides 31 of the spring housing 24. Slots 55 between the actuator tabs 53, 54 on the two opposite side edges of the module receiving the camming studs 42 on the actuator bail arms 40. At this point, polarization and rough guidance have taken place. The arrangement of the tabs and their mating slots is such that the module can only be inserted as shown because if the module is turned 180° before insertion, the tabs will not engage in the mating slots. As the inserted module approaches the plate 26 of the spring housing 24, the pair of guide studs 47 on the module will engage mating slots 56 in the plate which provides a fine guidance means to assure that the I/O pins correctly engage the openings in the plate.

Figure 7:
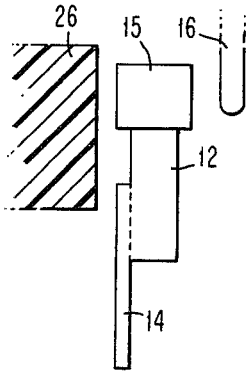
FIG. 7 is a side showing of a contact spring in normal position and a module I/O pin inserted adjacent thereto.

Visual indication that the module is fully seated is given by the actuator bail 36 which develops significant free travel once the module is in place vertically, as viewed in FIG. 3. The bail can pivot freely between its rest position on the latch points 38 on the bail retaining latch and the sloping top portion of the slots 35 with the camming studs 42 on the bail moving freely in the larger portion of slots 55. The hooked ends of the guide tabs 51, 52 are in a position to be slid under matching ledges in the spring housing to prevent upward motion of the module. With the module fully seated, the I/O pins 16 are positioned adjacent to the contact surfaces 15 of the contact springs, as illustrated in FIGS. 6 and 7. The vertical position of the I/O pins is determined by a pad 57 (FIG. 1) in each corner of the spring housing plate 26 on which the module seats.

Figure 4:
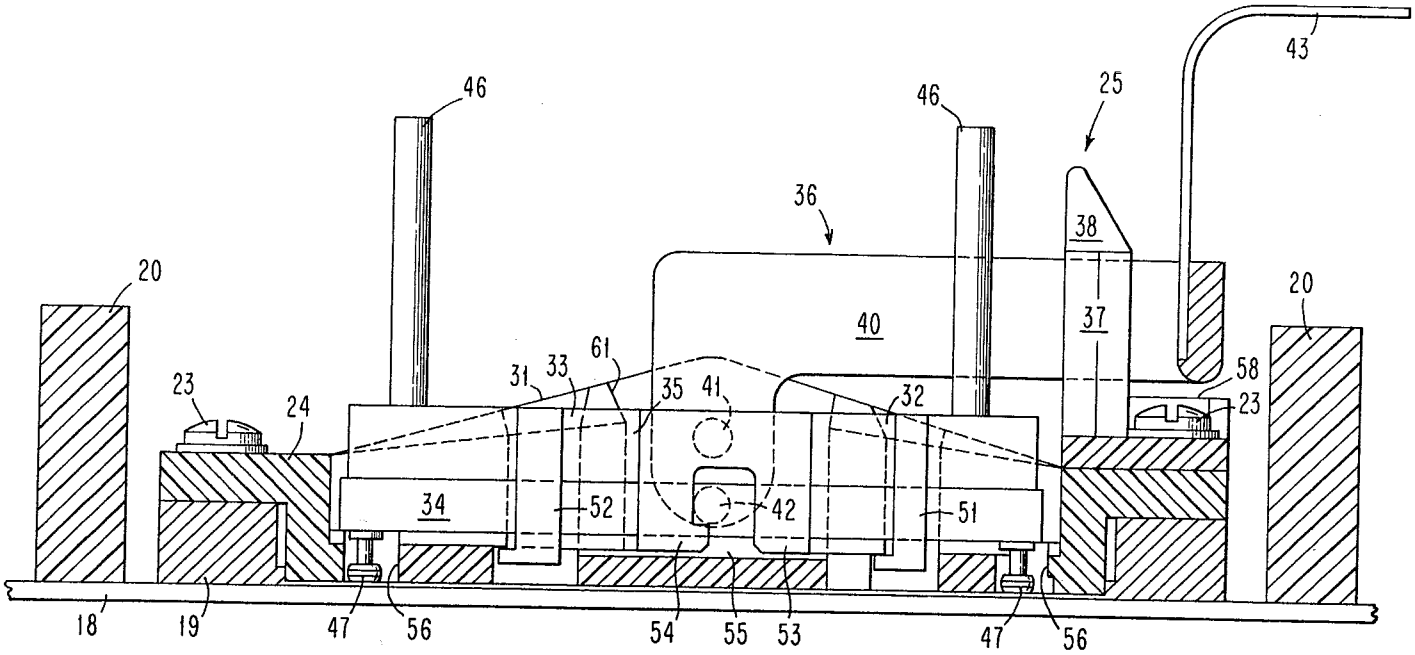
FIG. 4 is a cutaway side view of the assembled device and module with the module in actuated and latched position.
Figure 8:
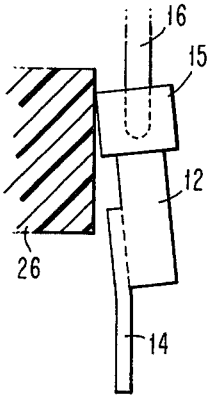
FIG. 8 is a side showing of the position of the contact spring of FIG. 7 with the module I/O pin driven to an over center position.

Referring to FIGS. 3 and 4, horizontal motion of the module I/O pins into engagement with the contact springs is accomplished by depressing the operating handle 43 to pivot the actuator bail 36 in a clockwise direction on its pivot studs 41. This action causes the camming studs 42 on the bail arms to move toward the left and engage the actuator tabs 54 on the module to move the module in the actuation direction toward the left. The bail retaining latch arms 37 are yieldable in a direction transverse to the direction of bail movement and as the bail is depressed, the bail arms will slide down the outwardly sloping surface of the latch points 38 as the latch arms and points bend toward each other. When the bail arms clear the latch points, the retaining latch arms will snap back away from each other and into engagement with the bail arms. This gives a visual indication that module actuation has been accomplished and that the I/O pins are in engagement with the contact springs. The device is provided with an "over center" actuation feature and, at this point, the I/O pins have been over driven such that they enter between the contact surfaces 15 of the contact springs and, due to the friction therebetween, will bend the contact springs forward in the direction of pin travel until the contact surfaces 15 are against the wall of the openings 28, as illustrated in FIG. 8. The bail retaining latch mechanism 25 is provided with a positive stop ledge 58 which stops the depression of the actuator bail to prevent over actuation of the bail and breakage of the contact springs.

Figure 1:
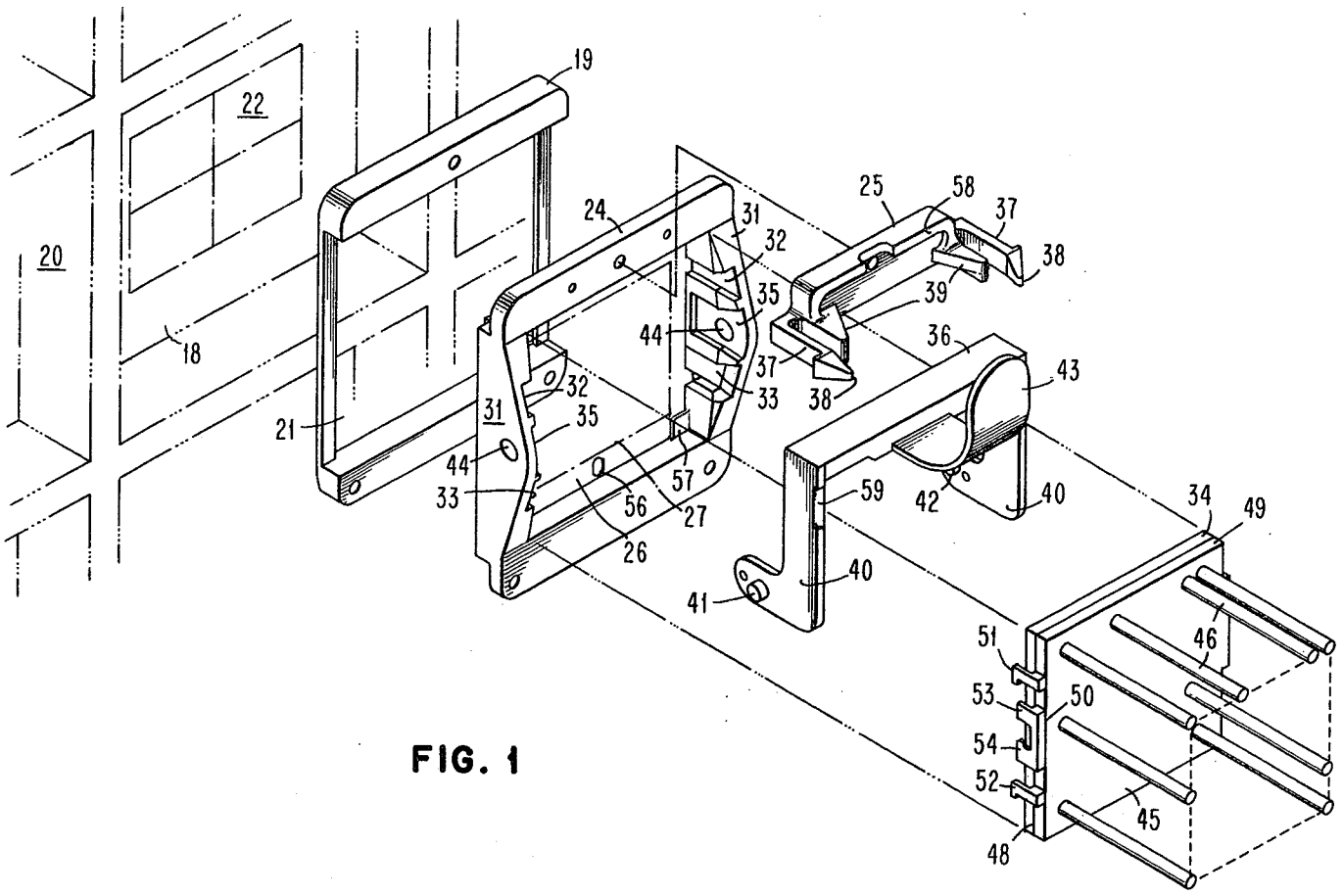
FIG. 1 is an exploded isometric view of the pluggable module actuation and retention device of the present invention.
Figure 2:
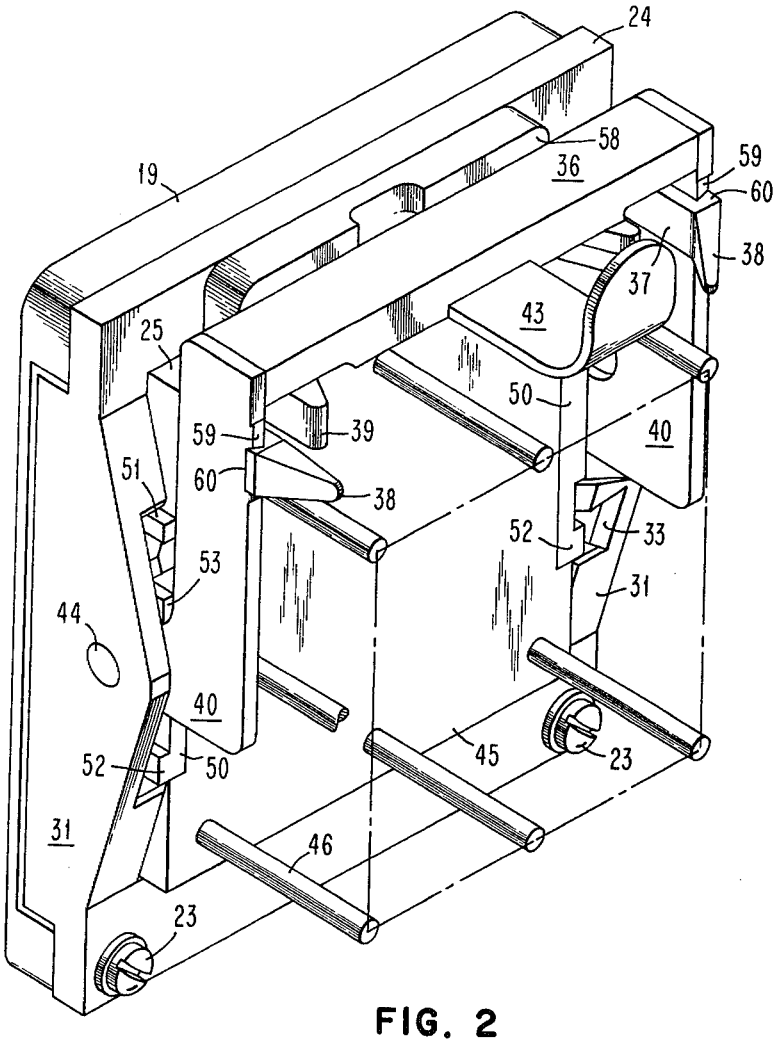
FIG. 2 is an assembly isometric view of the device of FIG. 1 showing a module in actuated and latched position.
Figure 9:
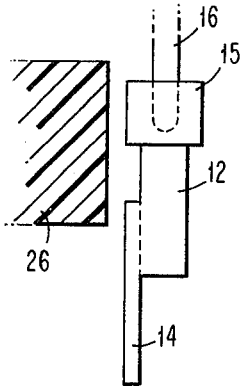
FIG. 9 is a side showing of the position of the contact spring and module pin of FIG. 8 after completion of module actuation.

The actuator bail is now released and upon release, the tension in the over driven contact springs will drive the module and I/O pins back until the contact springs and pins reach a state of equilibrium and are in the center position of engagement, as illustrated in FIG. 9. Referring to FIG. 2, the bail arms 40 each have a notch 59 which is cut at an angle which matches the angle 60 cut in the base portion of the latch points 38 and the released bail arms will move back and seat into the cut base portion of the latch points. The distance of this movement corresponds to the distance that the I/O pins were over driven. The bail arms are now latched by the latch points and the module is retained in the actuated position and is prevented from backing out. Also, the hooked ends of the guide tabs 51, 52 (FIG. 4) have slid under the spring housing 24 to vertically retain the module. In both cases, the spring pin frictional force will assist in retention. The over driving of the pins and contact springs and their return to a center position is desirous because it leaves the engaged contact springs free of any strain or tension which would cause them to weaken and break during use of the board in electronic equipment.

Deactuation of the module is accomplished by squeezing the bail retaining latch arms toward each other to unlatch the bail and simultaneously lifting or rotating the bail to pivot it counterclockwise which results in camming studs 42 engaging actuator tabs 53 and camming the module back to its deactuated position, shown in FIG. 3, and moving the I/O pins out of engagement with the contact springs. The bail will pivot counterclockwise until the bail arms engage the deactuation stop angle portion 61 of slot 35. The hooked ends of the guide tabs 51, 52 slide back from under the spring housing and the module is now free to be lifted out of the device. The stop projections 39 on the bail retaining latch prevent the latch arms from being squeezed too far and thereby overstressing and breaking them when deactuating the module.

The present device is quick and simple to operate, economical to manufacture, and it accomplishes all of the desired objectives previously set forth. The latching arrangement is particularly effective in preventing both vertical and horizontal movement of the actuated module and it prevents the module from becoming unplugged or out of contact engagement which could result under operating conditions due to the vibration of the equipment on which the modules and circuit boards are used.

Another feature of the present device is that it can accommodate modules of varying heights without having to be modified. This is advantageous since modules can vary substantially in height depending, for example, on the type of heat sink they employ.

While the invention has been particularly shown and described with reference to a preferred embodiment thereof, it will be understood by those skilled in the art that various changes in form and details may be made therein without departing from the spirit and scope of the invention.

What is claimed is:

1. A module actuation and retention device for connecting a matrix of I/O pins of a pluggable module to a matrix of contact springs protruding from a surface of a planar printed circuit member, which comprises:

spring housing means fastened to said surface of said circuit member and having through openings for housing the contact springs in said matrix;

an actuator bail pivotally connected on said spring housing means and having an opening which overlies all of the through openings in said spring housing means;

a pluggable module having a matrix of I/O pins corresponding to said matrix of contact springs;

guide tab elements and actuator tab members extending from two opposite side edges of said module;

guide tab element and actuator tab member mating slots on two opposite sides of said spring housing for receiving said guide tab elements and actuator tab members when a module is inserted through the opening in said bail in a direction normal to said surface of said circuit member to align the matrix of I/O pins on said module into the through openings in said housing means and position each I/O pin adjacent to an associated contact spring; and camming means on said actuator bail effective when said bail is pivoted in one direction to coact with said actuator tab members to slide said module laterally and move the matrix of I/O pins thereon into engagement with said matrix of contact springs; said camming means comprising a pair of studs and said actuator tab members comprising a pair of tabs separated by a slot having a narrow entrance portion which opens into a wider portion, said wider portion receiving said studs when the module is fully inserted in the direction normal to the surface of the circuit member whereby the actuator bail will have sufficient free movement to indicate that the I/O pins are positioned adjacent to their associated contact springs.

2. A module actuation and retention device for connecting a matrix of I/O pins of a pluggable module to a matrix of contact springs protruding from a surface of a planar printed circuit member, which comprises:

spring housing means fastened to said surface of said circuit member and having through openings for housing the contact springs in said matrix;

an actuator bail having a pair of arms pivotally connected to said spring housing means and having an opening between said arms which overlies all of the through openings in said spring housing means;

a pluggable module having a matrix of I/O pins corresponding to said matrix of contact springs;

guide tab means and actuator tab means on said module;

guide tab and actuator tab mating means on said spring housing means for receiving said guide and actuator tab means when a module is inserted through the opening in said bail in a direction normal to said surface of said circuit member to align the matrix of I/O pins on said module into the through openings in said spring housing means and position each I/O pin adjacent to an associated contact spring;

camming means on said actuator bail effective when said bail is depressed and pivoted in one direction to coact with said actuator tab means to slide said module laterally and move the matrix of I/O pins thereon into engagement with said matrix of contact springs;

bail retaining latch means fastened to said spring housing means and having a pair of longitudinally extending latch arms which are yieldable toward and away from each other;

a latch point on the end of each latch arm having an outwardly sloping surface and a base portion having an inwardly sloping surface;

said bail arms normally resting on the outwardly sloping surface of said latch points and effective when the actuator bail is pivoted in said one direction to bend said latch arms toward each other until the bail arms move past said latch points which allows the latch arms to bend away from each other and into engagement with the bail arms; and positive stop means on said bail retaining latch means for stopping said bail when the bail arms have moved past said latch points at which point the I/O pins have been over-driven and engage the contct springs in an off-center position, so that pin/contact friction in said off-center position provides a spring force effective when said bail is released to pivot the bail in the opposite direction until the bail arms seat in the base of said latch points and at which point the I/O pins and contact springs will move to a center position of engagement.

3. A device as set forth in claim 2 wherein said module is deactuated by squeezing said latch arms toward each other to unlatch said bail arms and lifting said bail to pivot it opposite to said one direction to move the module laterally back to its deactuated position and the I/O pins out of engagement with the contact springs; and latch arm stop means fastened on said bail retaining latch means to prevent over squeezing of said latch arms.

* * * * *